United States Patent [19]

Brown

[11] 4,135,462

[45] Jan. 23, 1979

[54] X-Y PATTERNING BY ELECTRONICALLY CONTROLLED HOUSEHOLD SEWING MACHINE

[75] Inventor: Jack Brown, Union, N.J.

[73] Assignee: The Singer Company, New York, N.Y.

[21] Appl. No.: 881,948

[22] Filed: Feb. 28, 1978

[51] Int. Cl.[2] ..... D05B 3/00; D05B 27/20

[52] U.S. Cl. ..... 112/158 E; 112/213

[58] Field of Search ..... 112/158 E, 213, 206, 112/158 R, 48, 49, 81

[56] References Cited

U.S. PATENT DOCUMENTS

| | | | |
|---|---|---|---|
| 804,220 | 11/1905 | Gray | 112/213 |
| 3,561,382 | 2/1971 | Ketterer et al. | 112/213 |
| 4,016,821 | 4/1977 | Minalga | 112/158 E |

*Primary Examiner*—Peter Nerbun

*Attorney, Agent, or Firm*—Edward P. Schmidt; Robert E. Smith; Edward L. Bell

[57] ABSTRACT

An electronically controlled household sewing machine capable of effecting ornamental stitches by selective needle feed and needle positioning, in conjunction with reversible work feed. Means are provided for storing and returning needle jogging instructions intended to be accomplished not only while the needle is out of the work to provide zig zag stitches, but also intended to be accomplished while the needle is in the work to provide for lateral needle feed of the work. An arrangement is disclosed whereby combinations of zig zag, needle feed and longitudinal feed of the work may be influenced between successive needle penetrations. In this manner, in addition to the longitudinal work feed motion, the work material may be moved laterally by the sewing needle in the formation of ornamental patterns having unlimited width as well as longitudinal extent for which the stitch coordinate information is stored and applied to the stitch forming instrumentalities electronically.

3 Claims, 8 Drawing Figures

Fig. 1
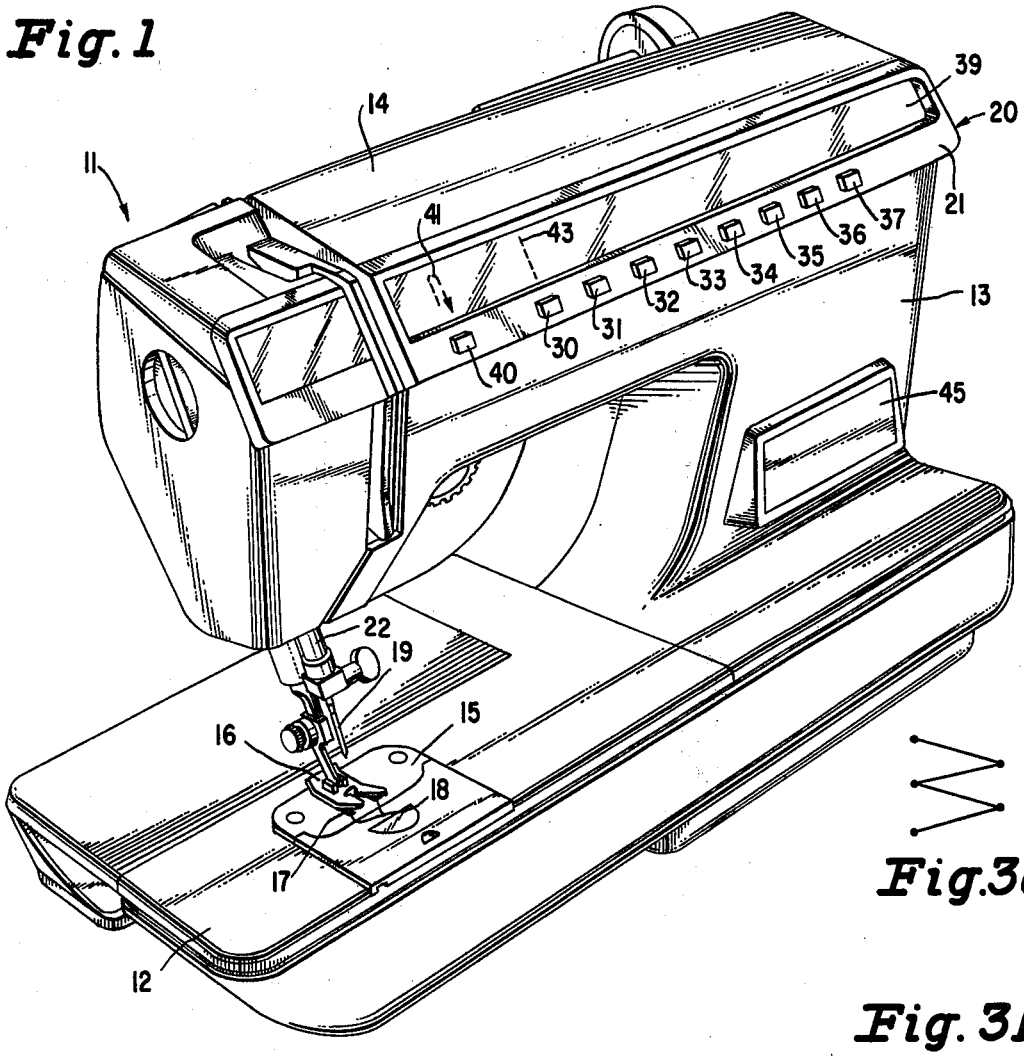
Fig.3a
Fig. 3b
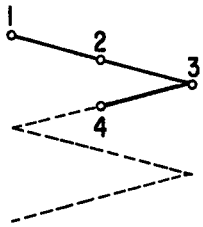
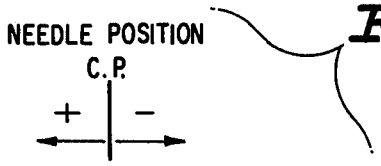
Fig. 3
ENCODED DATA FOR ENLARGED ZIG-ZAG
| STITCH NO. | PULSE LOW TO HIGH | | PULSE HIGH TO LOW | | | |
|---|---|---|---|---|---|---|
| | BIGHT | | NEEDLE FEED | | WORK FEED | |
| | CODE | NEEDLE POS. | CODE | NEEDLE POS. | CODE | FEED INCR. |
| 1 | 00011 | + .120 | 00011 | + .120 | 01011 | + .060 |
| 2 | 11011 | − .120 | 00011 | + .120 | 01011 | + .060 |
| 3 | 11011 | − .120 | 11011 | − .120 | 01011 | + .060 |
| 4 | 00011 | + .120 | 11011 | − .120 | 01011 | + .060 |

Fig. 4a
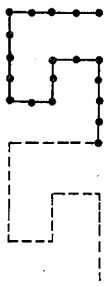
Fig. 4b
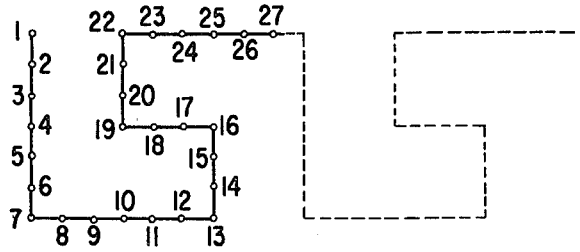
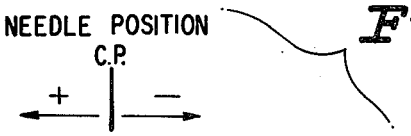
Fig. 4
ENCODED DATA FOR ENLARGED LATERAL GREEK KEY
| STITCH NO. | PULSE LOW TO HIGH | | PULSE HIGH TO LOW | | | |
|---|---|---|---|---|---|---|
| | BIGHT | | NEEDLE FEED | | WORK FEED | |
| | CODE | NEEDLE POS. | CODE | NEEDLE POS. | CODE | FEED INCR. |
| 1 | 11011 | −.120 | 00011 | +.120 | 01001 | +.080 |
| 2 | 00011 | +.120 | 00011 | +.120 | 01001 | +.080 |
| 3 | 00011 | +.120 | 00011 | +.120 | 01001 | +.080 |
| 4 | 00011 | +.120 | 00011 | +.120 | 01001 | +.080 |
| 5 | 00011 | +.120 | 00011 | +.120 | 01001 | +.080 |
| 6 | 00011 | +.120 | 00011 | +.120 | 01001 | +.080 |
| 7 | 00011 | +.120 | 10011 | -.040 | 10010 | 0 |
| 8 | 11011 | −.120 | 10011 | -.040 | 10010 | 0 |
| 9 | 11011 | -.120 | 10011 | -.040 | 10010 | 0 |
| 10 | 11011 | −.120 | 10011 | -.040 | 10010 | 0 |
| 11 | 11011 | −.120 | 10011 | -.040 | 10010 | 0 |
| 12 | 11011 | −.120 | 10011 | -.040 | 10010 | 0 |
| 13 | 11011 | −.120 | 00011 | +.120 | 11011 | -.080 |
| 14 | 00011 | +.120 | 00011 | +.120 | 11011 | -.080 |
| 15 | 00011 | +.120 | 00011 | +.120 | 11011 | -.080 |
| 16 | 00011 | +.120 | 01011 | +.040 | 10010 | 0 |
| 17 | 00011 | +.120 | 01011 | +.040 | 10010 | 0 |
| 18 | 00011 | +.120 | 01011 | +.040 | 10010 | 0 |
| 19 | 00011 | +.120 | 00011 | +.120 | 11011 | -.080 |
| 20 | 00011 | +.120 | 00011 | +.120 | 11011 | -.080 |
| 21 | 00011 | +.120 | 00011 | +.120 | 11011 | -.080 |
| 22 | 00011 | +.120 | 10011 | -.040 | 10010 | 0 |
| 23 | 11011 | -.120 | 10011 | -.040 | 10010 | 0 |
| 24 | 11011 | -.120 | 10011 | -.040 | 10010 | 0 |
| 25 | 11011 | -.120 | 10011 | -.040 | 10010 | 0 |
| 26 | 11011 | -.120 | 10011 | -.040 | 10010 | 0 |
| 27 | 11011 | -.120 | 10011 | -.040 | 10010 | 0 |

X-Y PATTERNING BY ELECTRONICALLY CONTROLLED HOUSEHOLD SEWING MACHINE

BACKGROUND OF THE INVENTION

The invention relates to electronically controlled household sewing machines, and more particularly, to such a sewing machine which has the capability for lateral feeding in addition to longitudinal feeding according to information retained in a static memory.

It is known in the prior art, to provide for sewing machines having lateral feeding capability. There is, for example, in the Japanese Patent Publication No. 27028/65, applied for Dec. 24, 1963, a disclosure of a mechanical sewing machine wherein fabric may be fed laterally by a lateral motion of the sewing needle while in a work material, to produce, for example, a random pattern having an extra wide bight. There is also shown in U.S. Pat. No. 3,561,382 of Ketterer et al, a sewing machine having a removable cam mechanism which influences motion of the needle bar and needle attached thereto while in the work material thereby to effect lateral shift thereof. More recently, my U.S. patent application Ser. No. 858,497, filed Dec. 8, 1977, disclosed a means for economically converting an electronically controlled sewing machine to obtain lateral feeding or a limited degree of lateral patterning.

There is also a body of prior art in the class of sewing machines known as needle feed machines. This prior art relates to a particular type of industrial sewing machine which normally includes a needle bar mechanism oscillatable in the line of feed while undergoing endwise reciprocation. Normally, an industrial sewing machine having a needle feed is dedicated to this particular type of operation, without potential for conversion to any other type of operation.

Heretofore, household sewing machines have been limited to the formation of ornamental patterns having a pattern width, or bight, determined by, among other things, the maximum relative displacement between the sewing needle and the loop taker at which a stitch may be formed. Thus, a wide variety of ornamental patterns may be formed which are however, relatively narrow although theoretically of infinite length. An ideal situation would be where a sewing machine is able to stitch over a large area not necessarily confined to narrow boundries. There are special purpose sewing machines, such as quilting machines, which are able to cover a large area but are well out of the scope of the usual household sewer. What is required is a means for obtaining in a household sewing machine automatic implementation of patterns which exceed the capabilities of heretofore known family sewing machines with respect to size and complexity.

SUMMARY OF THE INVENTION

This invention relates to sewing machines and more particularly to an arrangement in a sewing machine for providing ornamental patterns of stitches unlimited in width as well as longitudinal extent.

This invention is implemented by a sewing machine provided with a needle capable of being reciprocated into and out of a work fabric being stitched and also capable of being jogged laterally, together with a work feeding mechanism arranged to transport the work fabric longitudinally. Unlimited width as well as longitudinal extent of ornamental patterns is attained by storing and utilizing stitch pattern information which includes not only commands for longitudinal feed of the work by the work feeding mechanism but also lateral feed of the work by commands dictating jogging of the needle laterally while the needle is reciprocated into engagement with the work fabric. Up to the limit of the total possible lateral excursion of the needle in its jogging motion, this invention comprehends the provision of stored predetermined stitch patterns in which varying proportions of the total possible lateral excursion of the needle are caused to occur during as well as between predetermined needle penetrations.

This invention has particular application to a sewing machine having means for storing and applying ornamental stitch pattern commands electronically.

DESCRIPTION OF THE DRAWINGS

In the accompanying drawings a preferred embodiment of this invention is illustrated in which:

FIG. 1 is a perspective view of a sewing machine having this invention applied thereto;

FIG. 3 is a table listing the binary code words necessary to produce an enlarged zig zag stitch pattern using a sewing machine controlled in accordance with the diagram of FIG. 2;

FIG. 3*a* represents a plain zig zag stitch utilizing the maximum width of pattern attainable without utilization of this invention;

FIG. 3*b* represents a laterally enlarged zig zag stitch obtained by use of this invention employing the stitch pattern as listed in the table of FIG. 3;

FIG. 4 is a table listing the binary code words necessary to produce an enlarged Greek Key stitch pattern using a sewing machine controlled in accordance with the diagram of FIG. 2;

FIG. 4*a* represents a Greek Key stitch pattern utilizing the maximum width of pattern attainable without utilization of this invention; and FIG. 4*b* represents the laterally enlarged Greek Key stitch pattern obtained by use of this invention employing the stitch pattern as listed in the table of FIG. 4.

DESCRIPTION OF THE PREFERRED EMBODIMENT

Figure 2:
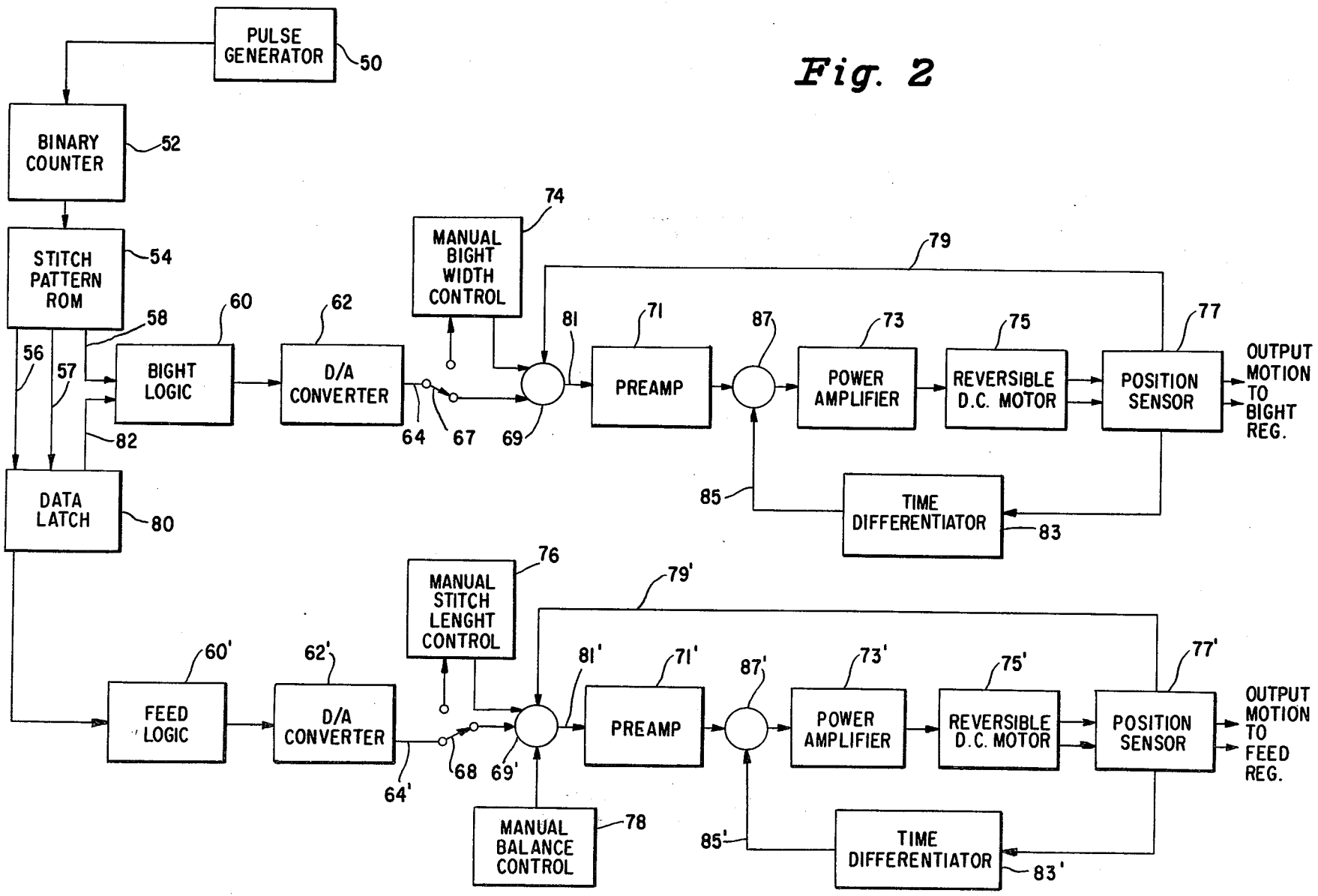
FIG. 2 is a simplified block diagram of an electronically controlled zig zag sewing machine to which this invention has been applied.

Referring to FIG. 1 of the drawings, 11 indicates a sewing machine frame including a work supporting bed 12 from which rises a standard 13 which sustains a bracket arm 14 overhanging the bed. A throat plate 15 carried on the bed supports the thrust of a spring loaded presser device 16 carried in the bracket arm. Work fabrics to be stitched are urged by the presser device 16 downwardly against the throat plate and against the work feed dog 17 which works upwardly through slots 18 in the throat plate feed the work. While any known sewing machine work feeding mechanism may be employed, that disclosed in U.S. Pat. No. 3,872,808 which is incorporated herein by reference, is a preferred form. The throat plate 15 is also apertured to accommodate the reciprocation of a needle 19 carried on the end of a needle bar 22, which needle bar is supported in the bracket arm 14 for endwise reciprocation and lateral oscillation in a manner well known in the sewing machine art. There is a limit to the maximum lateral excursion of the needle which is determined by the needle jogging mechanism and by the lateral dimension of the needle aperture in the throat plate.

The bracket arm of the sewing machine is preferably fitted with a control assembly 20 which may be constructed substantially in accordance with that disclosed in U.S. Pat. No. 3,913,506 which is incorporated herein by reference. Preferably, the control assembly includes an escutcheon plate 21 through which a plurality of pattern selection buttons 30 to 37 protrude, and a transparent insert 39 through which indicia in close association with the selector buttons is visible. An additional button 40 is provided shiftably supported to protrude through the escutcheon plate 21 for the purpose of manually influencing reverse stitching. For further particulars on the manner in which reverse stitching is accomplished, the reader is referred to U.S. Pat. No. 3,977,338 issued on Aug. 31, 1976 to Wurst et al. Suitable indicia 41 may be arranged on the transparent insert 39 above the feed reversing button 40 to identify the purpose of this control element for a machine operator. Similarly, indicia 43 may be supplied above selector button 30, operation of which would influence straight stitching. A panel 45 is provided on the forward surface of the standard 13, which panel serves to normally conceal those controls necessary to vary bight, feed, or feed balance for closed patterns such as buttonholes.

Referring now to FIG. 2, there is shown a general schematic block diagram for the sewing machine by which the needle bar 22 and the sewing needle 19 carried thereby may be shifted to a selected lateral position, and the feed dog 17 may be moved in a selected direction at a selected rate for feeding of work material in a longitudinal direction. Further specifics on the location and interrelation of the components shown in the block diagram to each other and to the sewing machine instrumentalities may be had by reference to the U.S. Pat. No. 3,984,745, issued on Oct. 5, 1976 to Minalga and assigned to the same assignee as the instant invention, which patent is hereby incorporated by reference and made a part of this application. Thus, a pulse generator 50 which may be driven by any mechanically actuated part of the sewing machine 11 is arranged to provide a high pulse when the sewing needle 19 leaves a work material and a low pulse when the sewing needle 19 reenters a work material. Some details on the form and operation of such a pulse generator may be had by reference to the U.S. Pat. No. 3,939,372 issued Feb. 17, 1976 to Wurst et al, and assigned to the same assignee as the instant invention, which is hereby incorporated by reference and made a part of this application. It will be understood that other forms of pulse generators may be utilized in the invention, and that other forms of timing may be used however, that form of timing described above where the pulse generator shifts from a low state to a high state upon removal of the needle 19 from a work material will be adhered to in the remainder of the specification. The pulse shifts from low to high generated by the pulse generator 50 are counted in a binary counter 52 in order to provide an address input for the stitch pattern ROM 54 which increases for each stitch to provide a successive pattern of stitches in the formation of ornamental pattern. For a greater understanding of the manner in which this is accomplished, and the way in which pattern selection by way of selector buttons 30–37 may be made, the reader is referred to the U.S. Pat. No. 3,872,808, issued on Mar. 25, 1975 to Wurst, which is assigned to the same assignee as the instant invention, and is hereby incorporated by reference and made a part of this application. The address from the binary counter 52 to the stitch pattern ROM 54 causes the ROM to provide a digital output therefrom with information related to the positional coordinates for each stitch of a selected pattern. The output from the stitch pattern ROM 54 passes along three lines 56, 57, 58. The bight information from the stitch pattern ROM 54 passes along line 58 to the bight logic 60 processing for example into pulse width modulated form and for retention for the duration of the stitch. Thereafter, the pulse width modulated signal will pass from the bight logic 60 to the digital to analog converter 62 for conversion to an analog form suitable for use by the servo motors. The converter 62 outputs on line 64 a DC analog voltage representing the required bight position input. This line connects, in the automatic mode position of a switch 67 to the summing point 69 of a low level preamplifier 71 forming the first stage of a servo amplifier system. The preamplifier 71 drives a power amplifier 73 which supplies direct current of reversible polarity to the electromechanical actuater 75, which in the broadest sense comprises a reversible motor, to position the actuater in accordance with the input and voltage on line 64. A feedback position sensor 77 mechanically connected to the reversible motor 75 provides a feedback positional signal on line 79 indicative of the existing output position. The input analog voltage and the feedback are algebraically summed at the summing point 69 to supply an error signal on line 81. The feedback signal from the position sensor is also differentiated with respect to time in a differentiator 83 and the resulting rate signal is presented on line 85 to the summing point 87 of the power amplifier 73 to modify the positional signal at that point. A position sensor 77 may be any device that generates an analog voltage proportional to position and may, in this embodiment, be a simple linear potentiometer connected to a stable reference voltage and functioning as a voltage divider. The differentiator 83 is preferrably an operational amplifier connected to produce an output signal equal to the time rate of change of the input voltage as is well known in this art. The explanation of the bight actuating circuitry completed thus far will also serve to explain the feed actuating circuitry operation. Corresponding blocks in each system which are substantially similar carry the same reference number except that the numbers associated with the feed system are primed. In the explanation completed thus far the only substantial difference would be that the switch 68 for the feed shown in the automatic position is given a different number to signify that its operation is not dependent on operation of the bight switch 67. Since feed actuating circuit is substantially similar to the bight actuating circuit thus far described, no further explanation will be required of the feed actuating circuit. The remainder of the explanation will be directed toward the substantial differences between the bight and feed actuating circuits.

Referring once again to FIG. 2, it will be recalled that the bight switch 67 is shown in the position for automatic operation according to stitch pattern information stored in the ROM 54. If a bight switch 67 were thrown to the manual position, the signal on line 64 would pass to the manual bight width control 74 before passing to the summing point 69. The manual bight width control may be located behind the panel 45 in the sewing machine 11 shown in FIG. 1. The purpose of this control is to permit the signal from the stitch pattern ROM 54 to be altered to suit the needs or desires of a sewing machine operator. Further particulars on how this may be accomplished may be had by reference to U.S. Pat. No.

4,016,821, issued Apr. 12, 1977 to Minalga which is assigned to the same assignee as the instant invention and is hereby incorporated by reference herein. By way of explanation it is sufficient to note that the manual bight width control 74 is implemented by an operational amplifier in which the bypass resistance may be modified to vary the gain thereof thereby to vary the analog signal on line 64 prior to connection to the summing point 69. In the feed actuating circuit, positioning of the feed switch 68 to the manual position will connect the feed analog signal on line 64' to a manual stitch length control 76 which may also be implemented by an operational amplifier having a variable bypass resistance to vary the gain thereof. The output motion of the conventional feed dog 17 is accurately controlled in direction and amount by the sewing machine feed system (not shown) supported within the bed 12 of the sewing machine 11. The actual amount of feed imparted to the work itself does not necessarily follow in a one to one relationship therewith and depends on many factors including the nature and thickness of the work, the pressure applied by the presser foot and the rate of feed. To compensate for such discrepancy, it is necessary to introduce at summing point 69' a balance control voltage derived from a potentiometer connected as a voltage divider to the double ended reference voltage output of a power supply. Further specifics on the manual balance control 78 shown in FIG. 2 may be had by reference to the above noted patent.

As referred to above, the pulse generator 50 passes from a low state to a high state when the sewing needle 19, moving in an upstroke, comes out of contact with the work material. The low to high pulse from the pulse generator 50 advances the binary counter 52 one step and signals release of pattern stitch information from the stitch pattern ROM 54, thereby permitting specific bight information to pass along line 58 to the bight logic 60. Simultaneously specific feed information passes along line 56 to a data latch 80 where this information is retained until the proper time for release. In normal stitch patterning, when the sewing needle 19 is removed from a work material the needle carrying bar 22 may be positioned for a subsequent stitch and the work material may be operated on by the feed dog 17 to move the fabric in a longitudinal direction. Longitudinal feed motion takes place after the sewing needle 19 is withdrawn from the fabric and prior to reentry of the fabric by the sewing needle. When the sewing needle 19 reenters the work material, the feed dog 17 becomes ineffective to feed the work material and usually partakes of an idle return to a starting position. During the interval while the sewing needle 19 is in a work material, a feed regulator of a work feed system of the sewing machine may be manipulated to prepare for a new feed rate and direction for the succeeding stitch. Thus, the feed information must be retained in the data latch 80 until that time when the sewing needle 19 reenters a work material. As set forth above, the pulse generator 50 passes from a high state to a low state when the sewing needle 19 reenters a work material. This high to low pulse step of the pulse generator 50 signals the feed latch 80 to release the feed information retained therein to the feed logic 60' for processing and retention for the digital to analog converter 62' amplification and operation of the reversible DC motor 75' in order to achieve a new feed rate and/or direction.

Thus far there has been described an electronically controlled sewing machine having stitch pattern capability retained in a static memory implemented by the stitch pattern ROM 54. A sewing machine so equipped may perform a multiplicity of ornamental patterns within the confines of the lateral excursion capability of the needle, the patterns may be of unlimited length according to the variable rate and direction information retained in the stitch pattern ROM 54 along with the needle position information. In order to enlarge upon the capabilities of a household sewing machine of this form to generate ornamental patterns, there is required some means of obtaining lateral feeding in the direction of needle jogging. This is most efficaciously accomplished by moving the needle bar 22 and the sewing needle 19 attached thereto while the sewing needle is in engagement with a work material. Thus, the sewing needle 19 in addition to forming the stitch with the loop taker of the sewing machine, carries the work material laterally. Lateral motion of the work material thus accomplished by the sewing needle 19 may be followed by longitudinal work feed motion performed by the feed dog 17, which is part of the usual sewing machine feed system. In order to attain automatic rendition of ornamental patterns having lateral needle feed motion in addition to longitudinal feed motion, the stitch pattern ROM 74 must include additional stitch pattern information for the bight actuating circuits which will be implemented when the sewing needle 19 is in engagement with the work material. In order to release this supplemental stitch pattern information from the ROM 54 when the sewing needle 19 is in engagement with the work material, the supplemental pattern information is released from the ROM on line 57 when the pulse generator 50 passes from a low to a high state. This supplemental pattern needle feed information is retained in another section of the data latch 80 to be released on line 82 to the bight logic 60 at the same time as feed pattern information is released to the feed logic 60'. This supplemental needle feed information is processed and retained in the bight logic 60 as a continuing signal to the digital to analog converter 62 for operation of the servo amplifiers and reversible DC motor 75 positioning the needle 19 while in engagement with the work material. This process is repeated for each stitch of alternate lateral feed and longitudinal feed so that, depending upon the storage capability of the ROM 54, a rather large pattern in the X-Y directions may be implemented.

In the formation of ornamental patterns using heretofore known sewing machines, the only information required to be stored was the stitch width, that is, lateral change of needle position between stitches and the work feed required to move to the next stitch. In a household sewing machine in accordance with the invention as herein described, additional information is required to be stored defining needle starting position prior to penetration of the work material, and new needle position to be achieved while the needle is in engagement with the work material, in order to accommodate a pattern having X-Y coordinates implemented by lateral feed in addition to the usual longitudinal work feed. It is evident that the initial needle position prior to penetration of the work material is of some interest to the final needle position after needle feed as determining the extent of lateral feed which may be accomplished. For example, if the sewing needle 19 were positioned in the extreme left position when out of contact with the work material and penetration of the work material took place at the extreme left position, the sewing needle may be moved to the extreme right position while the sewing needle is in contact with the material thereby moving the work material over the full bight capability of the sewing machine. If, however, the sewing needle 19 was to penetrate the work material at center needle position lateral motion to the right or to the left may only take place for one half of the bight capability of the sewing machine. Thus, for the purpose of this patent application, the sewing needle 19 will be moved to the extreme left position if lateral motion to the right is desired, or to the extreme right position if lateral motion to the left is desired. It will be appreciated that the sewing needle 19 may be moved to an intermediate position when out of contact with a work material, with subsequent lateral feed to an extreme right or left position as desired, however, for the purposes of this description the initial needle position of the sewing needle 19 when out of contact with work material will be the extreme left or right for lateral motion to the right or left, respectively.

Referring now to FIGS. 3, 3*a* and 3*b* there is shown in FIG. 3*a* the normal maximum bight zig zag stitch obtainable by the sewing machine 11 or prior art sewing machines. In FIG. 3*b*, there is shown the enlarged bight zig zag stitch attainable by the sewing machine 11 using the teachings incorporated herein. The table shown in FIG. 3 indicates the binary code words retained in the stitch pattern ROM 54 and released sequentially therefrom in order to achieve the pattern indicated in FIG. 3*b*. Adjacent each code word is the needle position dimension from center needle position, and the feed increment dimension represented by the binary code word. Center position (CP) would therefore be zero, and full left needle position would be + 0.120, and right needle position would be − 0.120. A positive feed increment would indicate forward feed and a negative feed increment would indicate reverse feed. Therefore, when the sewing needle 19 is removed from a work material, the pulse from the pulse generator 50 goes from low to high releasing the bight, needle feed and feed code words from the stitch pattern ROM 54. The bight binary code representing full left needle position is released immediately to the bight logic 60. The needle 19 is moved immediately to the left needle position. The sewing needle 19 is urged downwardly by the sewing machine actuating mechanism, and when it extends into the work material, the pulse from the pulse generator 50 goes from a high to a low state. This transition of the pulse from a high to a low state releases the needle feed information from the data latch 80 which, since there is no change in stitch one, requires no motion of the sewing needle 19. Simultaneously with the release of the needle feed information, the work feed information is released from the data latch 80 to the feed logic 60' causing the feed actuating circuits to implement repositioning of a feed regulator of a work feed system in the sewing machine 11 in preparation for a work feeding step when the sewing needle 19 is next removed from the work material. On stitch number two, the bight information released when the needle is out of the fabric causes motion of the sewing needle 19 from the extreme left position to the extreme right position. When the sewing needle 19 reenters the fabric, the needle feed information for stitch two is released from the data latch 80 to the bight logic 60 causing the sewing needle 19 to move to the + 0.120 position or full left needle position carrying the work material therewith. Simultaneously therewith, the feed regulator is again moved to a new position in preparation for the succeeding work feeding motion when the sewing needle is removed from the work material. In stitch number three, the sewing needle 19 is removed from the work material and again moved to the extreme right position (− 0.120). Since there is no change in needle position when the sewing needle 19 passes through the work material, no lateral feeding takes place on stitch three. When the sewing needle 19 is in the work material, the binary code for the work feed maintains the feed regulator in the same position as in the prior two stitches for another feed increment motion. In stitch four, when the sewing needle 19 is removed from the work material, the sewing needle moves to the extreme left position, and upon reentering the work material is moved to the extreme right position carrying the work material with it in a rightwardly direction. The binary code word for the work feed is the same as in the previous three stitches to cause the work material to feed longitudinally the same increment in the forwardly direction. Thereupon, as explained in the above reference U.S. Pat. No. 3,872,808, the stitch pattern ROM 54 may output an end code word to the binary counter 52 in order to reset the counter to repeat stitches 1–4 in sequence.

By an inspection of FIG. 3*a* and 3*b*, it is apparent that the sewing machine 11 herein described has the capability for effecting a zig zag stitch with a width exceeding the maximum lateral excursion of the needle between successive stitches. The density of the zig zag stitch so achieved is strictly a function of the programmed work feed increment. Although the zig zag stitch of FIG. 3*b*, and the encoded data therefore, is for a zig zag stitch having approximately twice the bight of that shown in FIG. 3*a*, it will be apparent that using the teachings herein disclosed zig zag patterns of extremely large width are made possible. For example, in place of stitch three the stitch two may be repeated as frequently as desired. On the return motion to the left, the stitch four may be repeated as many times as is necessary. The work feed increment may also be altered to alter the density of the zig zag as desired.

The zig zag stitch shown in FIG. 3*b* serves to indicate the enlarged bight capabilities attainable using the teachings of this disclosure. In FIG. 4*a*, there is shown a Greek key pattern attainable using conventional stored needle position information in stored feed increment and direction information. By the same method used to obtain the enlarged zig zag stitch of FIG. 3*b*, it will be appreciated that it is entirely possible to obtain an enlarged Greek key extending longitudinally. However, in order to demonstrate the flexibility of the X-Y patterning capability as provided by this invention, the encoded data has been supplied for obtaining an enlarged Greek key extending in the lateral direction by use of needle feed. From an inspection of the encoded data of FIG. 4 for the enlarged lateral Greek key, it will be noted that in stitch one the sewing needle 19 enters the fabric at the extreme right position and moves the fabric to the extreme left position, representing a positioning of the work material from the prior stitch 27 to the new stitch one. In stitches two through six there is no change in needle position with no needle feed, and only longitudinal work feed increment. In stitch seven the work material is shifted laterally to the right an increment of 0.160 (0.120 + 0.040). Movement of the work material to the right was required in order to permit subsequent repositioning of the work material to the left in the formation of stitches seven through 13. It is evident that with the sewing needle 19 in the full left position (+0.120) and laying a longtiudinal line of stitches that no motion to the left was possible until the fabric had been positioned somewhat to the right. Thus in stitches eight through 12 lateral steps of 0.080 (0.120 − 0.040) to the left were taken to move the work material leftwardly. For the stitches eight through 13 no work feed increment was taken. At stitch 13 the work material was again shifted to the left 0.240 (0.120 + 0.120) and a work feed reverse step was called for in preparation for stitch 14. At stitch 16 the work material was fed 0.080 (0.120 − 0.040) to the right in preparation for stitch 17. Stitch seventeen was again initiated at extreme left needle position and the work material was again shifted 0.080 to the right by needle feed. At stitches 19, 20 and 21 a reverse work feed increment again took place. At stitch 22 the work material was shifted 0.160 (0.120 + 0.040) to the right in order to prepare for subsequent shift of the work material to the left in steps of 0.080 from an initial right needle position (− .120), thereby achieving 0.080 dimension steps between stitches 22, 23, 24, 25, 26 and 27. After stitch 27 by the use of an encoded word in the stitch pattern ROM 54, the binary counter 52 may be reset to reinitiate stitching at stitch one.

The encoded data for the enlarged lateral Greek key was prepared to obtain a Greek key approximately twice the size of that obtainable from heretofore known household sewing machines. It will be readily apparent to those skilled in the art that an infinitely larger Greek key may be stitched by a machine as disclosed herein by repeating the groups of identical stitches a suitable number of times. It will be further evident to those skilled in the art that although the Greek key pattern disclosed is essentially rectilinear, an extremely large variety of ornamental patterns may be fashioned which are curvilinear by providing during the same stitch both needle feed and work feed increments. However, in order to avoid necessity for providing voluminous tables of encoded data which may be required for the explanation of such a pattern, this has been avoided.

The lateral feeding of work fabrics attainable using this invention may be facilitated by reduction of the pressure applied downwardly on the presser foot 16 of the sewing machine. Lateral feeding may also be facilitated by the use of special presser devices such as an even feeding foot which is supported by the sewing machine presser bar and driven by the needle bar. Such an even feeding foot is disclosed in my above referenced U.S. patent application Ser. No. 858,497 filed Dec. 8, 1977.

Having thus set forth the nature of the invention, what is sought to be claimed is:

1. In a sewing machine having stitch forming instrumentalities positionally controlled over a predetermined range to produce a pattern of successive feed and bight controlled stitches, said instrumentalities including a needle carrying bar supported for selective lateral jogging movement and for endwise reciprocation alternately to move a needle carried thereby into and out of engagement with a work material being sewn and including a work material feed system effective to feed a work material at a selective rate in a selected longitudinal direction substantially perpendicular to said lateral jogging movement of said needle carrying bar when said needle is out of engagement with said work material; electronic means for storing pattern stitch information; signal means operating in timed relation with the sewing machine for recovering selected pattern stitch information from said electronic storing means; feed actuating circuit means including an actuator; and bight actuating circuit means including an actuator responsive to said selected feed and bight pattern stitch information, respectively, for positioning said stitch forming instrumentalities to produce a pattern of stitches corresponding to the selected pattern stitch information; wherein the improvement comprises:

means for storing supplemental pattern stitch information for positioning said needle carrying bar when said needle moves into engagement with said work material, and means for applying said supplemental pattern stitch information to said actuator of said bight actuating circuit means while said needle is in engagement with said work material.

2. In a sewing machine having stitch forming instrumentalities positionally controlled over a predetermined range to produce a pattern of successive feed and bight controlled stitches, said instrumentalities including a needle carrying bar supported for lateral jogging movement and for endwise reciprocation alternately to move a needle carried thereby into and out of engagement with a work material being sewn and including a work material feed system effective to feed a work material at a selective rate in a selected longitudinal direction substantially perpendicular to said lateral jogging movement of said needle carrying bar when said needle is out of engagement with said work material; electronic means for storing pattern stitch information; signal means operating in timed relation with the sewing machine for recovering selected pattern stitch information from said electronic storing means; feed actuating circuit means including an actuator; and bight actuating circuit means including an actuator responsive to said selected feed and bight pattern stitch information, respectively, for positioning said stitch forming instrumentalities to produce a pattern of stitches corresponding to the selected pattern stitch information; wherein the improvement comprises:

means for storing supplemental pattern stitch information for positioning said needle carrying bar when said needle moves into engagement with said work material, for positioning said needle carrying bar when said needle moves out of engagement with said work material, and for feeding said work material at a selective rate in a selected direction when said needle moves out of engagement with said work material; and means for initiating application of said supplemental pattern stitch information to said actuator of said bight actuating circuit means while said needle is in engagement with said work material.

3. In a sewing machine having means for forming stitches on a work fabric including a work feeding mechanism for transporting said work fabric longitudinally, a thread carrying needle, means for imparting endwise reciprocatory work penetrating and withdrawing movements to said needle, means for imparting lateral jogging movements to said needle, and means limiting the total lateral excursion of said needle between successive work penetrations, ornamental stitch patterning means for producing stitch patterns unlimited in lateral as well as longitudinal dimensions comprising means for actuating said work feeding mechanism and for imparting lateral jogging motion to said needle in accordance with a predetermined pattern, means for influencing lateral needle jogging movements within said total lateral excursion of said needle to occur during work penetration of said needle, and means for controlling in accordance with a predetermined pattern the proportion of said lateral needle jogging motion which occurs during work penetration of said needle.

* * * * *